US008516837B2

(12) United States Patent
Swarup et al.

(10) Patent No.: US 8,516,837 B2
(45) Date of Patent: Aug. 27, 2013

(54) DEFROSTING A FREEZING UNIT AND LIQUID PURIFICATION

(75) Inventors: Mayank Swarup, New Delhi (IN); Tanvi Gupta, Uttar Pradesh (IN)

(73) Assignee: Manipal University, Manipal, Udupi (IN)

( * ) Notice: Subject to any disclaimer, the term of this patent is extended or adjusted under 35 U.S.C. 154(b) by 376 days.

(21) Appl. No.: 13/030,899

(22) Filed: Feb. 18, 2011

(65) Prior Publication Data

US 2012/0031120 A1 Feb. 9, 2012

(30) Foreign Application Priority Data

Aug. 4, 2010 (IN) ..... 2220/CHE/2010

(51) Int. Cl.
*F25D 21/12* (2006.01)

(52) U.S. Cl.
USPC ..... 62/82; 62/234; 62/509

(58) Field of Classification Search
USPC ..... 62/82, 80, 509, 512, 503, 85, 151, 62/234, 434, 318
See application file for complete search history.

(56) References Cited

U.S. PATENT DOCUMENTS 4,575,615 A * 3/1986 Shigenobu et al. ..... 392/450
4,617,910 A * 10/1986 Fardeau ..... 126/373.1
5,007,247 A * 4/1991 Danig ..... 62/174
5,207,761 A 5/1993 Ruff
5,269,151 A 12/1993 Dinh
5,669,222 A 9/1997 Jaster et al.
5,702,115 A * 12/1997 Pool ..... 280/47.35
5,996,372 A * 12/1999 Koda et al. ..... 62/503
6,973,797 B2 * 12/2005 Nemit, Jr. ..... 62/196.1
6,993,932 B2 * 2/2006 Lee et al. ..... 62/470
7,007,933 B2 * 3/2006 Lee et al. ..... 261/121.1
7,849,916 B2 * 12/2010 Atlas et al. ..... 165/287
8,266,922 B2 * 9/2012 Whitaker et al. ..... 62/389

OTHER PUBLICATIONS

Ciochetti et al., Pasteurization of Naturally Contaminated Water with Solar Energy, Applied and Environmental Microbiology, Feb. 1984, p. 223-228.

Foley et al., Cause of Microbial Death during Freezing in a Soft-Serve Ice Cream Freezer, Journal of Dairy Science, Aug. 1966, vol. 49, Issue 8, p. 928.

"Physical Methods of Microbial Control." Midlands Technical College. Web. <http://classes.midlandstech.edu/carterp/Courses/bio225/chap07/Control of Microbial Growth.htm>. 2004. Accessed Feb. 17, 2011.

* cited by examiner

*Primary Examiner* — Mohammad M Ali
(74) *Attorney, Agent, or Firm* — Foley & Lardner LLP

(57) ABSTRACT

A method and system for liquid purification and defrosting a freezing unit harvests energy released as heat from a condenser. Liquid received from a source into a first liquid storage container is heated using heat collected from the condenser using at least one heat conducting rod. A second liquid storage container connected to the first liquid storage container is maintained at a lower temperature than the first liquid storage container. As a first portion of heated liquid is transferred from the first liquid storage container to the second liquid storage container, bacteria in the first portion of heated liquid is denatured as a result of the temperature change, and the liquid is purified. Filters may also be used to improve purification. A second portion of heated liquid is transferred between the first liquid storage container and a freezing unit via at least one heat conducting pipe causing defrosting of the freezing unit.

20 Claims, 11 Drawing Sheets

DEFROSTING A FREEZING UNIT AND LIQUID PURIFICATION

CROSS REFERENCE TO RELATED APPLICATIONS

This application claims priority to Indian Patent Application Serial No. 2220/CHE/2010 filed Aug. 4, 2010, the contents of which are incorporated by reference herein in its entirety.

BACKGROUND

Power shortages are a global problem. In every country, energy is needed for industrialization and economic growth, and for increasing a standard of living for individuals. For example, energy is needed to run factories and businesses, and it is also needed in schools and homes. Many countries face severe energy shortages in the summer months when temperatures rise and the demand for cooling of all kinds increases.

In many countries, the energy shortage is present because a demand for energy exceeds resources currently available for energy production. However, increasing production of energy is an extensive process that may take many years. As an alternative to increasing energy production, steps may be taken to find ways of reducing per-capita power consumption. For example, home appliances that are active 24 hours a day, such as refrigerators, may consume more energy than needed, or may operate more than necessary.

Shortages of clean water are another global problem. Water, like energy, is a necessary resource for both economic and social development. Further, like energy, need for water increases during the warmer months of the year.

Additionally, water shortages can contribute to power shortages. In countries that do not have clean water sources, many households use water purifiers to clean the water for drinking and other uses. Water purifiers, like refrigerators, are active for a large portion of the day, resulting in nearly continuous energy consumption. Water purifiers are typically powered as stand-alone appliances, meaning they do not share or recycle the energy of any other appliance, and thus, may consume more energy than necessary.

SUMMARY

A system and method for liquid purification and defrosting a freezing unit is presented. The system collects energy released as heat from a condenser. In some embodiments, the system may be implemented in a refrigerator, or may be connected to a refrigerating unit, for example.

The system may comprise a first liquid storage container including at least one heat conducting rod. The system may further comprise a second liquid storage container connected to the first liquid storage container. The system may further comprise at least one heat conducting pipe connected to the first liquid storage container.

According to an embodiment, liquid is received from a source. The liquid is heated in the first liquid storage container using heat collected from the condenser. A first portion of the heated liquid is provided to the second liquid storage container wherein the temperature of the liquid is lower than temperature of the liquid in the first liquid storage container. As a result, bacteria in the heated liquid may be denatured and the liquid may be purified. Liquid may be removed from the second liquid storage container for use.

A second portion of the heated liquid in the first liquid storage container can be provided to a freezing unit via at least one heat conducting pipe. As a result, the freezing unit may be at least partially defrosted, for example. The second portion of the liquid can then be returned to the first liquid storage container.

In another aspect, a method of purifying water and defrosting a freezing unit is described. The method includes receiving water from a water source into a first water storage container, and heating the water in the first water storage container using heat collected from a condenser. The method also includes making a determination whether a second water storage container that is connected to the first water storage container includes an amount of water below a threshold level, and based on the determination, providing a first portion of the water in the first water storage container to the second water storage container. The method further includes providing a second portion of the water in the first water storage container to a freezing unit causing defrosting of the freezing unit, providing the water in the second water storage container to a user, and returning the second portion of the water from the freezing unit to the first water storage container.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
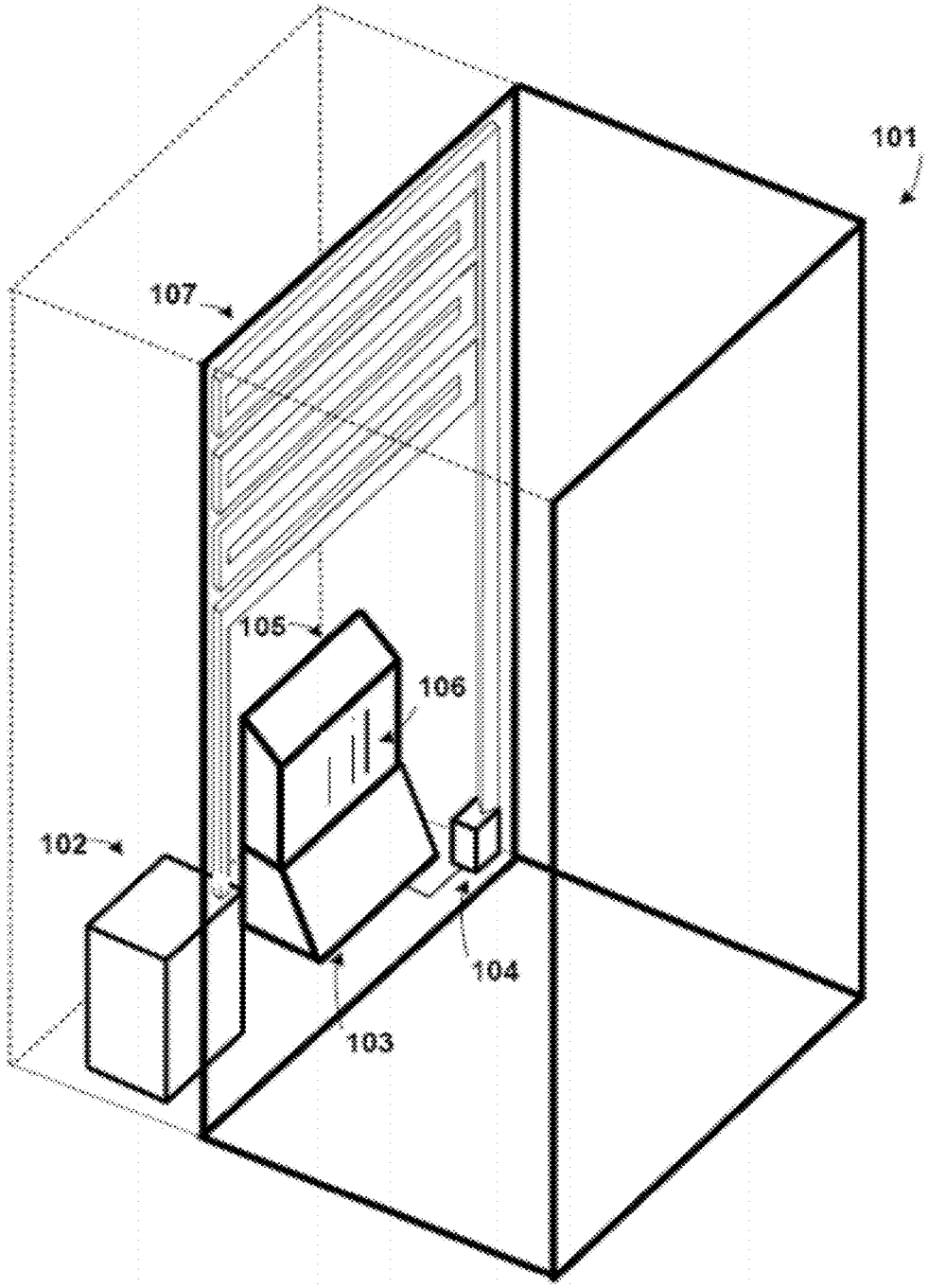
FIG. 1 depicts an example refrigerator including an example system for liquid purification and defrosting a freezing unit.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

FIG. 1 depicts an example refrigerator 101 including an example system for liquid purification and defrosting a freezing unit. The refrigerator 101 may operate according to any well-known refrigeration or cooling process. The refrigerator 101 is shown including a compressor 102, a condenser 103, an expander 104, and an evaporator 107 for use in the cooling process. Additionally, the refrigerator 101 is shown including a first liquid storage container 105 that includes at least one heat conducting rod 106. In some embodiments, the refrigerator 101 may have a volume greater than 250 liters.

The components of FIG. 1 are shown merely by way of illustration, and more or fewer components, both in number and type, may be present in real-world embodiments, depending on the purpose for which the embodiment is designed. Further, the relative positions of the components are merely illustrative unless context dictates otherwise. For example, any of the compressor 102, the condenser 103, the expander 104, the evaporator 107, or the first liquid storage container 105 may be included within the refrigerator 101, or may also be separate from the refrigerator 101 and connected to the refrigerator 101.

The cooling process of the refrigerator 101 may involve removing heat from an interior of the refrigerator 101. This heat is collected into and released by the condenser 103. The at least one heat conducting rod 106 inside the first liquid storage container 105 is in thermal contact with the condenser 103 such that the at least one heat conducting rod 106 absorbs or otherwise collects heat released from the condenser 103 and heats liquid contained in the first liquid storage container 105. In example embodiments, the system for liquid purification and defrosting a freezing unit makes use of this heated liquid, thus harvesting the energy released as heat by the refrigeration process.

The at least one heat conducting rod 106 is thermally conductive and serves to more efficiently collect heat released by the condenser 103, as the at least one heat conducting rod 106 is thermally more conductive than the liquid alone and increases the heated surface area working to increase the temperature of the liquid in the first liquid storage container 105. In one example, the at least one heat conducting rod 106 is directly and physically connected to the condenser 103. In another example, the at least one heat conducting rod 106 is not in direct physical contact with the condenser 103, however, due to a placement of the at least one heat conducting rod 106 near or in substantial proximity to the condenser 103, the at least one heat conducting rod 106 receives the heat released by the condenser 103. Depending on the size of the refrigerator 101, and the interior temperature to which the refrigerator 101 may be set, the at least one heat conducting rod 106 may have a temperature in the range of 50-65° C., for example. In the absence of any great heat loss, the liquid in the first liquid storage container 105 may reach the same temperatures as the at least one heat conducting rod 106. In some embodiments, the liquid in the first liquid storage container may be 45° C.

In one example, the at least one heat conducting rod 106 is made of copper. In other examples, the at least one heat conducting rod may be made of any thermally conductive material.

In another example, the first liquid storage container 105 does not contain any heat conducting rods 106. Rather, the first liquid storage container 105 is in direct physical contact with the condenser 103. Thus, the first liquid storage container 105 may absorb heat through physical contact with the condenser 103 without the use of at least one heat conducting rod 106. In some embodiments, however, heat conduction may not be as efficient in the absence of the at least one heat conducting rod 106.

Figure 2:
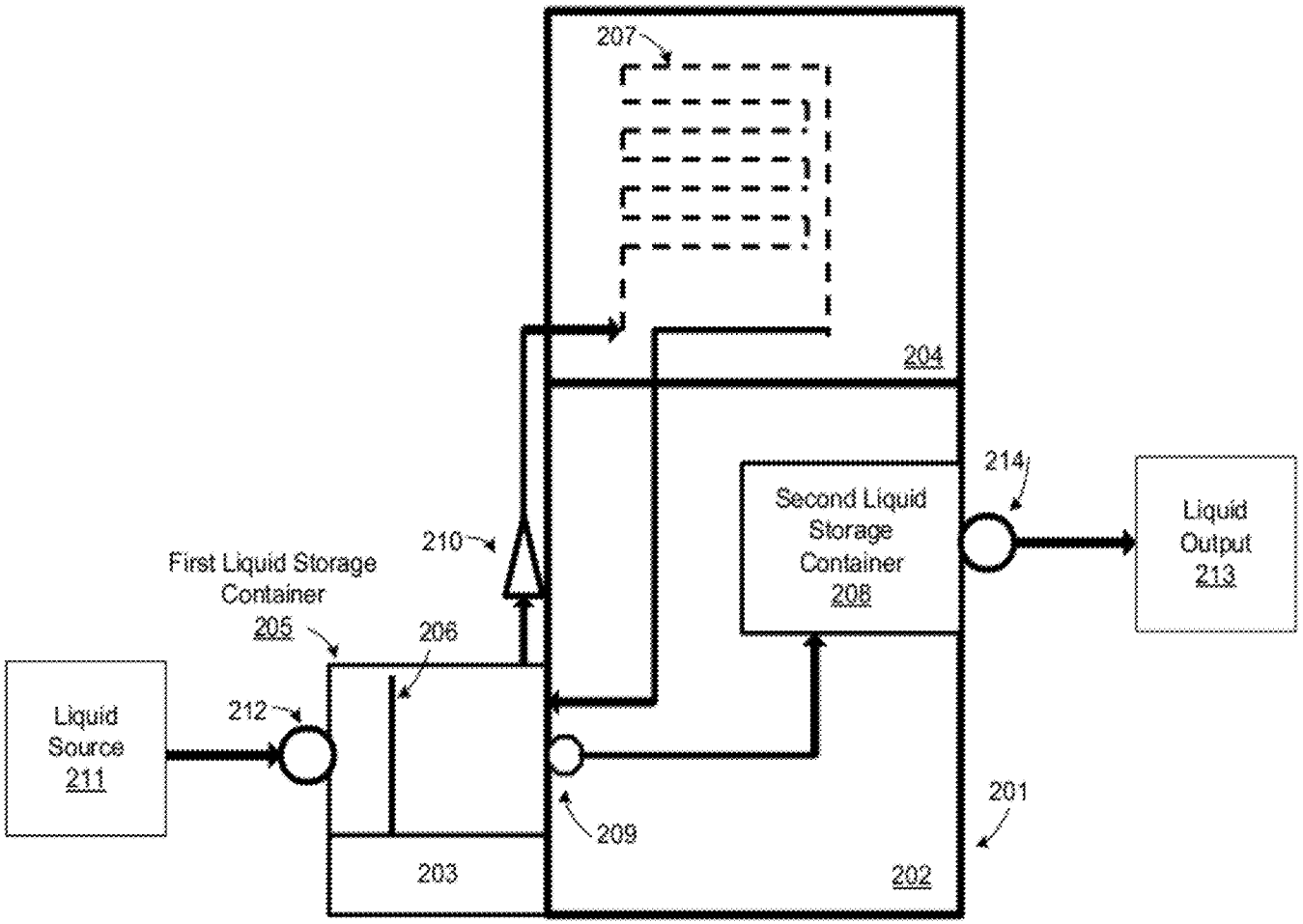
FIG. 2 depicts another example refrigerator including an example system for liquid purification and defrosting a freezing unit.

In another example, liquid in the first water storage container 105 may also be heated, at least in part, due to heat released by the condenser 103. For example, the first water storage container 105 may be placed in direct contact with or in near or substantial proximity to the condenser 103 so as to receive heat released by the condenser 103. In this manner, the at least one heat conducting rod 106 may not be used, or alternatively, may be used as a manner to transfer the heat through the first liquid storage container 105, for example. FIG. 2 depicts another example refrigerator 201 including an example system for liquid purification and defrosting a freezing unit. The components of FIG. 2 are shown merely by way of illustration, and unless context dictates otherwise variations of number, type, and position are possible depending on the purpose for which an embodiment is designed.

The refrigerator 201 is shown comprising a refrigerating unit 202, a freezing unit 203, and a condenser 204. The refrigerator 201 further includes an example system for liquid purification and defrosting the freezing unit 204. The system comprises a first liquid storage container 205 including at least one heat conducting rod 206, at least one heat conducting pipe 207 connected to the first liquid storage container 205, and a second liquid storage container 208 connected to the first liquid storage container 205. The first liquid storage container 205 may be located outside the refrigerator 201. The at least one heat conducting pipe 207 is located in the freezing unit 204 of the refrigerator 201. The second liquid storage container 208 is located inside the refrigerating unit 202 of the refrigerator 201.

In some embodiments, a control valve 209 is connected between the first liquid storage container 205 and the second liquid storage container 208. In some embodiments, a pump 210 is connected between the first liquid storage container 205 and the at least one heat conducting pipe 207, and may be used to pump liquid from the first liquid storage container 205 to the at least one heat conducting pipe 207.

Liquid is provided to the first liquid storage container 205 from a liquid source 211. This liquid source 211 may be a water source, and the liquid may be water. Other sources and liquids are possible as well. In some embodiments, a first filter 212 may be connected between the first liquid storage container 205 and the liquid source 211. The first filter 212 may be used for removing impurities from liquid entering the first liquid storage container 205. The first filter 212 could, for example, be a 0.2 μm filter. Other filters are possible as well.

Once the liquid has entered the first liquid storage container 205, the liquid may be heated by the heat collected from the condenser 203 through the at least one heat conducting rod 206. The heated liquid is then used in a process for liquid purification and a process for defrosting the freezing unit 204.

The process for liquid purification makes use of the liquid in the first liquid storage container 205 that has been heated by the heat collected from the condenser 203 through the at least one heat conducting rod 206. The heated liquid is removed from the first liquid storage container 205 and is received by the second liquid storage container 208. The liquid may then be removed from the second liquid storage container 208 and provided for use by a liquid output 213. In some embodiments, a second filter 214 may be connected to the second liquid storage container 208. The second filter 214 may be used for removing impurities from liquid leaving the second liquid storage container 208. The second filter 214 could, for example, be a 0.2 μm filter. Other filters are possible as well.

Figure 3:
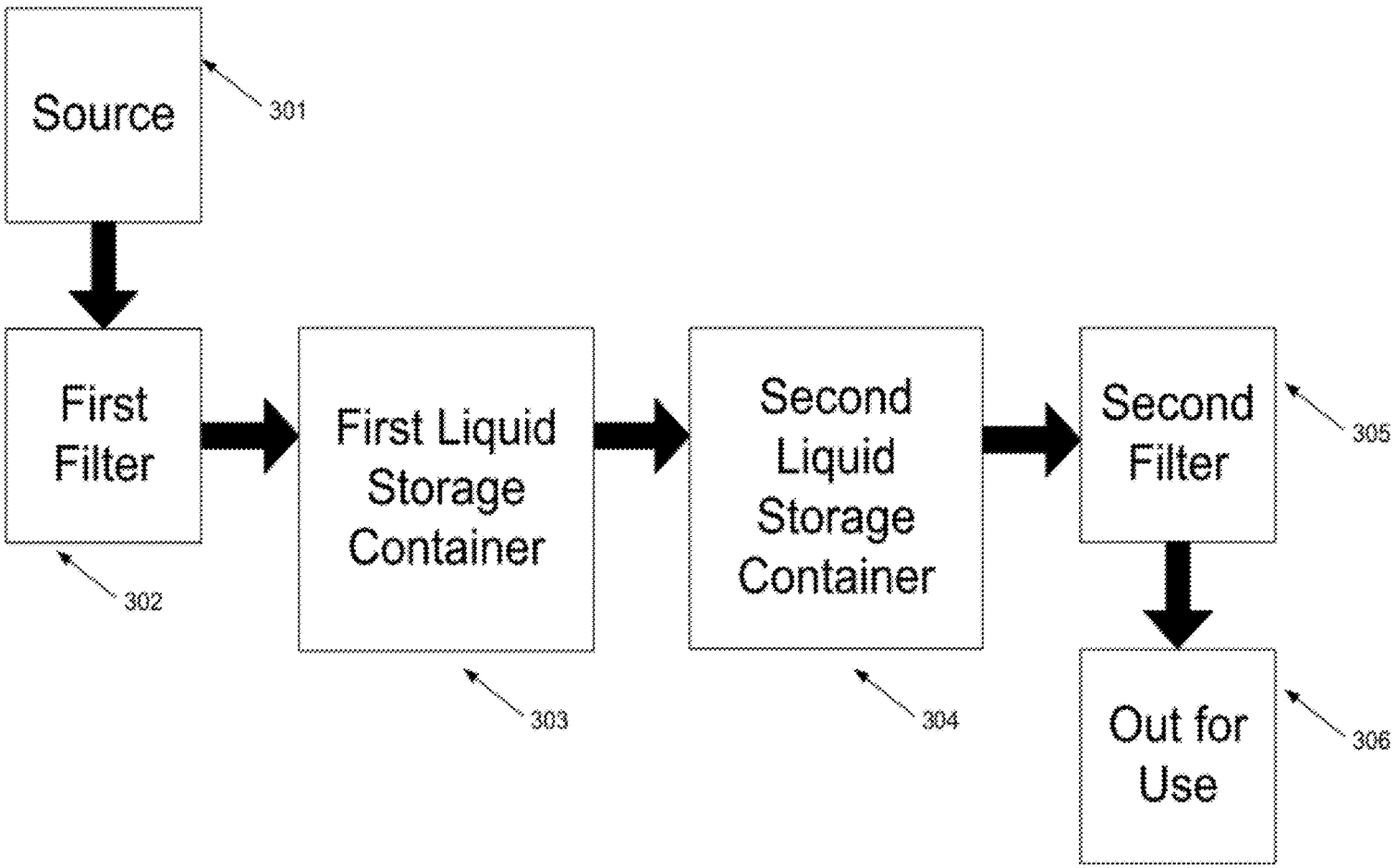
FIG. 3 depicts an example liquid flow process for liquid purification.

FIG. 3 depicts an example liquid flow process for liquid purification. The liquid flow process of FIG. 3 will be described in context of the system shown in FIG. 2. Initially, the liquid begins at the source 211, and in some embodiments, enters the first liquid storage container 205 through the first filter 212, as shown in blocks 301, 302, and 303. In the first liquid storage container 205, the liquid is heated by the heat collected from the condenser 203 through the at least one heat conducting rod 206.

Following, the second liquid storage container 208 receives heated liquid from the first liquid storage container 205, as shown at block 304. The liquid will decrease in temperature after being transferred to the second liquid storage container 208, and a process referred to as "thermal shock" may occur. Thermal shock is a sufficiently large and sudden drop in temperature, and can be used to denature bacteria in a liquid. By decreasing a temperature of a liquid from one temperature to a sufficiently lower temperature, bacteria in the liquid can be denatured.

The heated liquid received by the second liquid storage container 208 may thus undergo thermal shock. In particular, the heated liquid from the first liquid storage container 205 is transferred to the second liquid storage container 208, and a temperature in the second liquid storage container 208 is lower than the temperature of the liquid in the first liquid storage container 205. The temperature difference between the second liquid storage container 208 and the liquid in the first liquid storage container 205 is sufficient to cause thermal shock. In some embodiments, the temperature difference may be in the range of 35-55° C.

Thus, when the second liquid storage container 208 receives liquid from the first liquid storage container 205, the temperature difference denatures bacteria in the received liquid. That is, transfer of heated liquid from the first liquid storage container 205 to the second liquid storage container 208 causes the heated liquid to decrease in temperature resulting in denaturation of bacteria in the heated liquid.

The liquid can then be removed for use, and in some embodiments, is transferred from the second liquid storage container 208 through the second filter 214, as shown in blocks 305 and 306.

Returning to FIG. 2, the heated liquid can also be used in a process for defrosting the freezing unit 204. Thus, the process for defrosting a freezing unit also makes use of the liquid in the first liquid storage container 205 that has been heated by the heat collected from the condenser 203 through the at least one heat conducting rod 206. The heated liquid is removed from the first liquid storage container 205 and is received by the at least one heat conducting pipe 207. The at least one heat conducting pipe 207 serves to transfer heated liquid between the first liquid storage container 205 and the freezing unit 204. This transfer causes defrosting of the freezing unit 204. Once the heated liquid has flowed through the at least one heat conducting pipe 207, the heated liquid is returned to the first liquid storage container 205.

Figure 4:
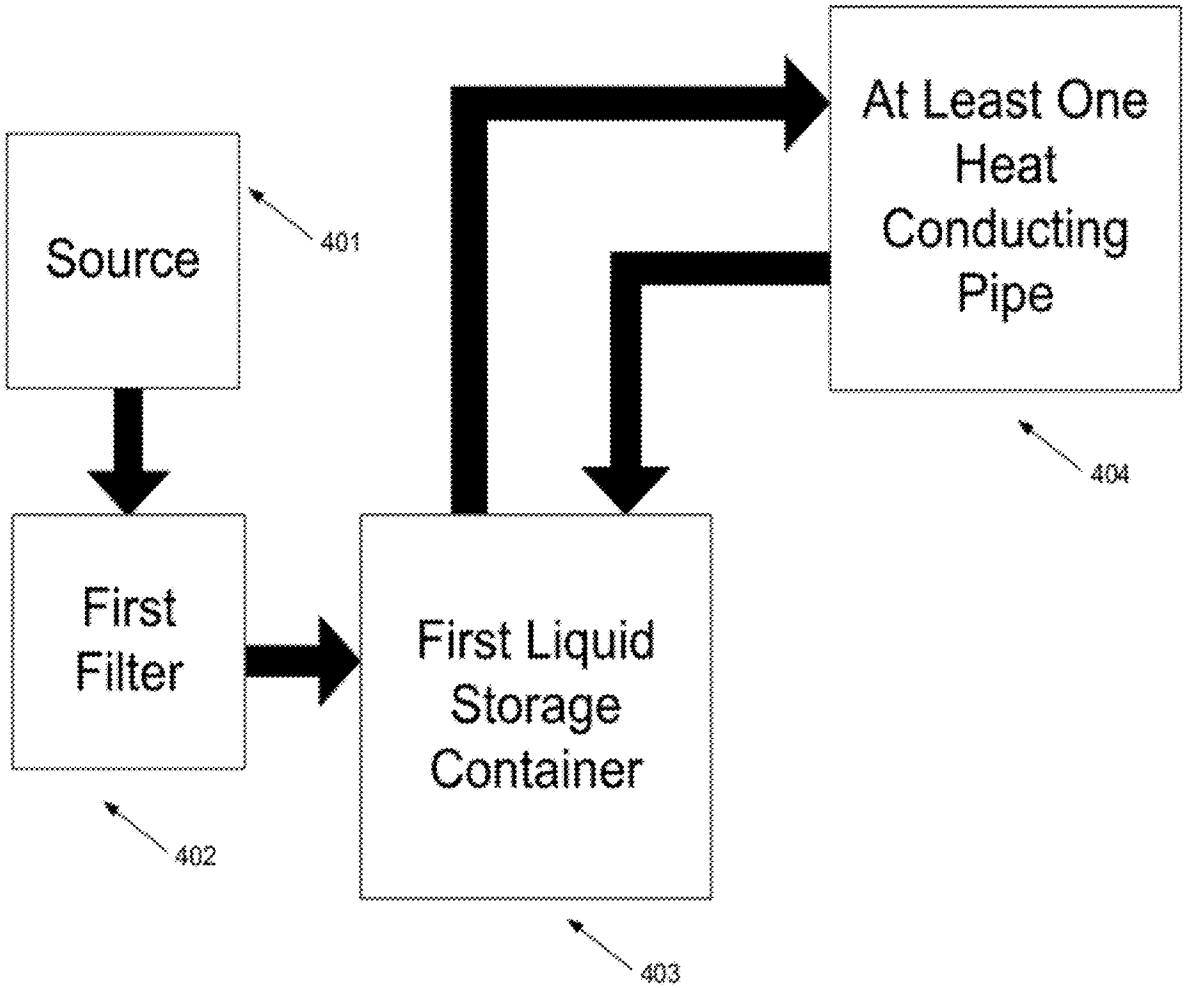
FIG. 4 depicts an example liquid flow process for defrosting a freezing unit.

FIG. 4 depicts an example liquid flow process for defrosting a freezing unit. The liquid begins at the source 211, and in some embodiments, enters the first liquid storage container 205 through the first filter 212, as shown in blocks 401, 402, and 403. In the first liquid storage container 205, the liquid is heated by the heat collected from the condenser 203 through the at least one heat conducting rod 206.

Following, a portion of the heated liquid is removed from the first liquid storage container 205 and is received by the at least one heat conducting pipe 207, as shown in block 404. As the heated liquid flows through the at least one heat conducting pipe 207, the heated liquid releases heat to the freezing unit 204, defrosting the freezing unit 204. As the heated liquid releases heat, the temperature of the heated liquid decreases. In some embodiments, the heated liquid may be in the at least one heat conducting pipe 207 for a length of time in the range of 2-3 minutes. As will be described below in connection with FIG. 9, the amount of time that the heated liquid is in the at least one heat conducting pipe 207 may be controlled using a variable resistance in the control circuit. In some embodiments, this amount of time may also depend on the internal temperature of the refrigerator.

The liquid is returned to the first liquid storage container 205 after flowing through the at least one heat conducting pipe 207. Upon returning to the first liquid storage container 205, the liquid is reheated.

Figure 5:
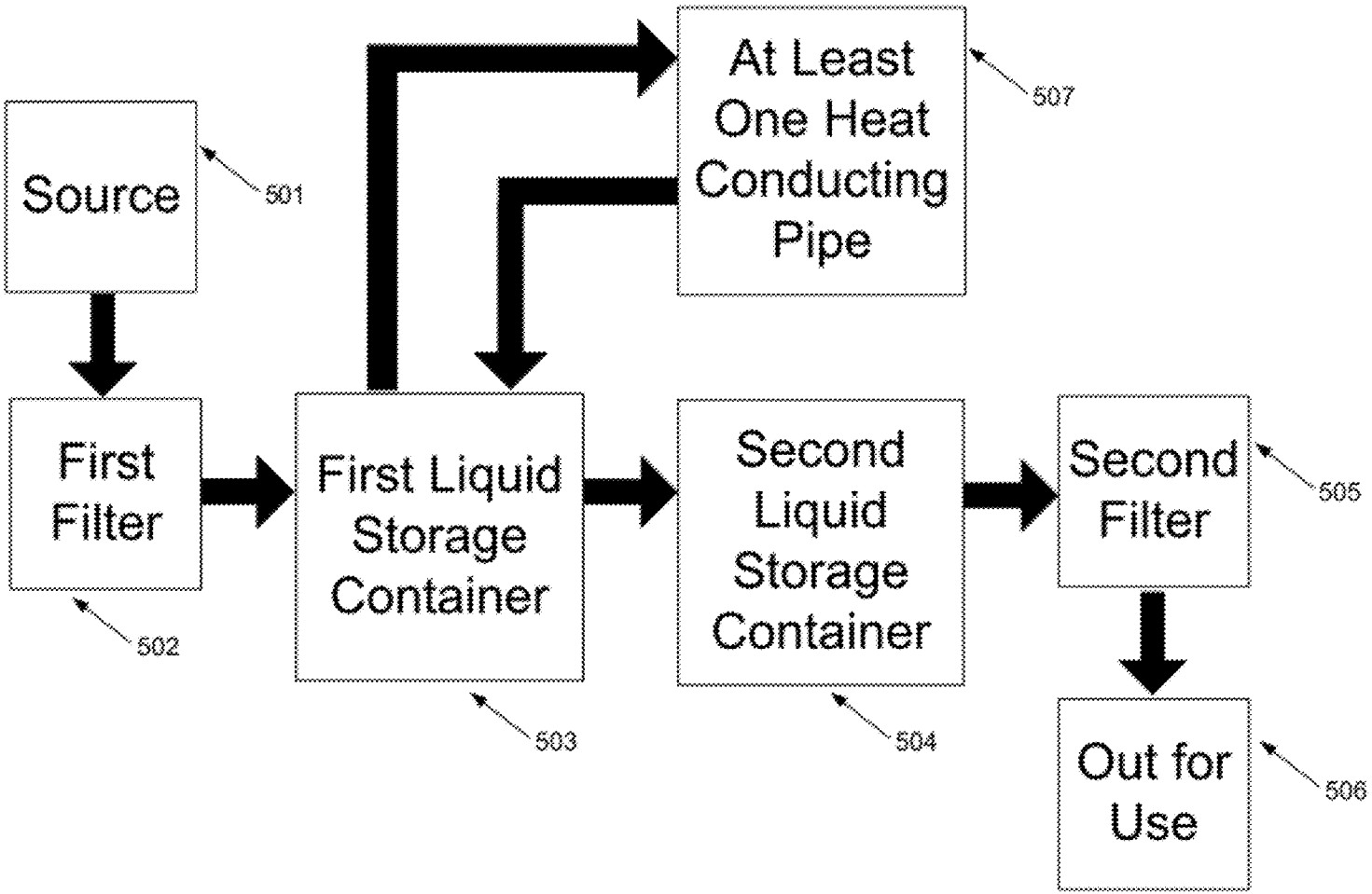
FIG. 5 depicts an example water flow process for liquid purification and defrosting a freezing unit.

FIG. 5 depicts an example liquid flow process for liquid purification and defrosting a freezing unit. As the two processes described in FIGS. 3 and 4 both make use of the liquid in the first liquid storage container 205 that has been heated by the heat collected from the condenser 203 through the at least one heat conducting rod 206, the processes can be combined. In an example combined process, the liquid begins at the source 211, and in some embodiments, enters the first liquid storage container 205 through the first filter 212, as shown in blocks 501, 502 and 503. In the first liquid storage container 205, the liquid is heated by the heat collected from the condenser 203 through the at least one heat conducting rod 206.

Following, the process for liquid purification may occur by providing heated liquid from the first liquid storage container 205 to the second liquid storage container 208, as shown at block 504, where thermal shock may occur. The liquid may then be provided to a user through the second filter 214, as shown at blocks 505 and 506. In addition, the process for defrosting a freezing unit may occur by providing the heated water from the first liquid storage 205 container to a freezing unit 204 via the at least one heat conducting pipe 207, as shown at block 507. Liquid may be returned to the first liquid storage container 205 after defrosting the freezer unit 204, for example. The two processes may be carried out simultaneously, alternately, periodically, or in any other fashion.

In one embodiment, only the process for liquid purification may be carried out. In another embodiment, only the process for defrosting a freezing unit may be carried out. In yet another embodiment, the temperature difference between the freezing unit 204 and the liquid in the first liquid storage container 205 is sufficient to cause thermal shock in the liquid being transferred to the at least one heat conducting pipe 207 in the freezing unit 204. In this embodiment, liquid used to defrost the freezing unit 204 may not be returned to the first liquid storage container 205, but rather may be transferred directly to the second liquid storage container 208 and subsequently out for use 213.

Alternately, in this embodiment liquid may be returned to the first liquid storage container 205 to be reheated and may then be transferred to the second liquid storage container 208, causing the liquid to undergo a second thermal shock. In a further embodiment, all liquid is first fed through the at least one heat conducting pipe 207, returned to the first liquid storage container 205, and then transferred to the second liquid storage container 208, such that the liquid has undergone two thermal shocks.

The processes for liquid purification and defrosting a freezing unit may be controlled separately as described below in FIGS. 8 and 9, for example.

Figure 6:
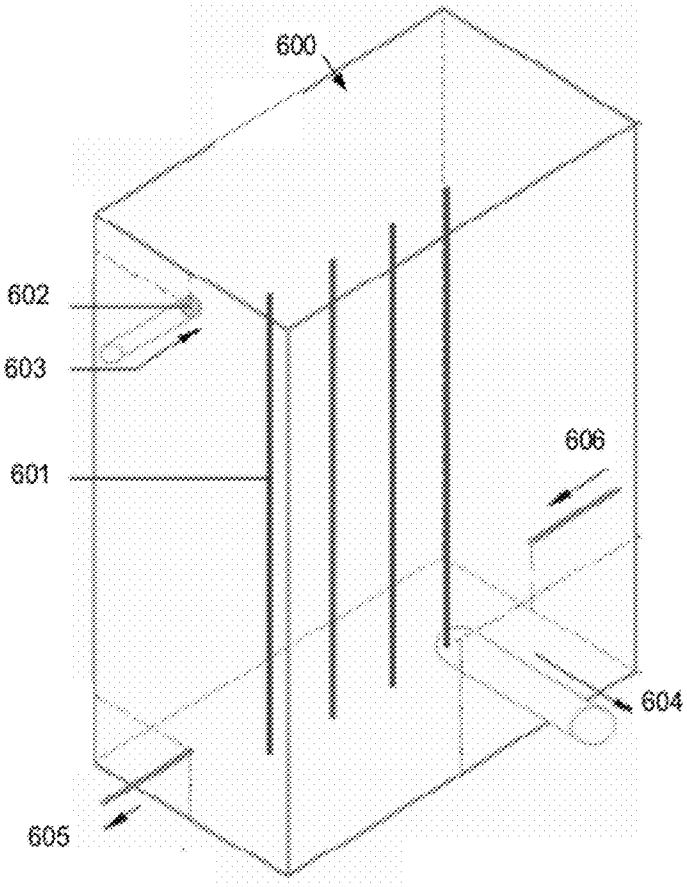
FIG. 6 depicts an example first liquid storage container for use in an example system for liquid purification and defrosting a freezing unit.

FIG. 6 depicts an example first liquid storage container 600 for use in an example system for liquid purification and defrosting a freezing unit. The components of FIG. 6 are shown merely by way of illustration, and unless context dictates otherwise variations of number, type, size, and position are possible depending on the purpose for which an embodiment is designed.

The first liquid storage container 600 is shown including a plurality of at least one heat conducting rod 601 and a first filter 602. Additionally, the first liquid storage container 600 is shown to include pipes 603, 604, 605, and 606. Pipe 603 carries liquid into the first liquid storage container 600 from a source (not shown). Pipe 604 carries liquid away from the first liquid storage container 600 to a second liquid storage container (not shown). The liquid that flows through pipe 604 to the second liquid storage container is used for the liquid purification process, and none of this liquid may return to the first liquid storage container 600, for example. Rather, this liquid is removed from the second liquid storage container for use.

Pipe 605 carries liquid away from the first liquid storage container 600 to at least one heat conducting pipe (not shown). The liquid that flows through pipe 605 to the at least one heat conducting pipe is used for defrosting a freezing unit. This liquid flows through the at least one heat conducting pipe and returns to the first liquid storage container 600 through pipe 606.

Figure 7:
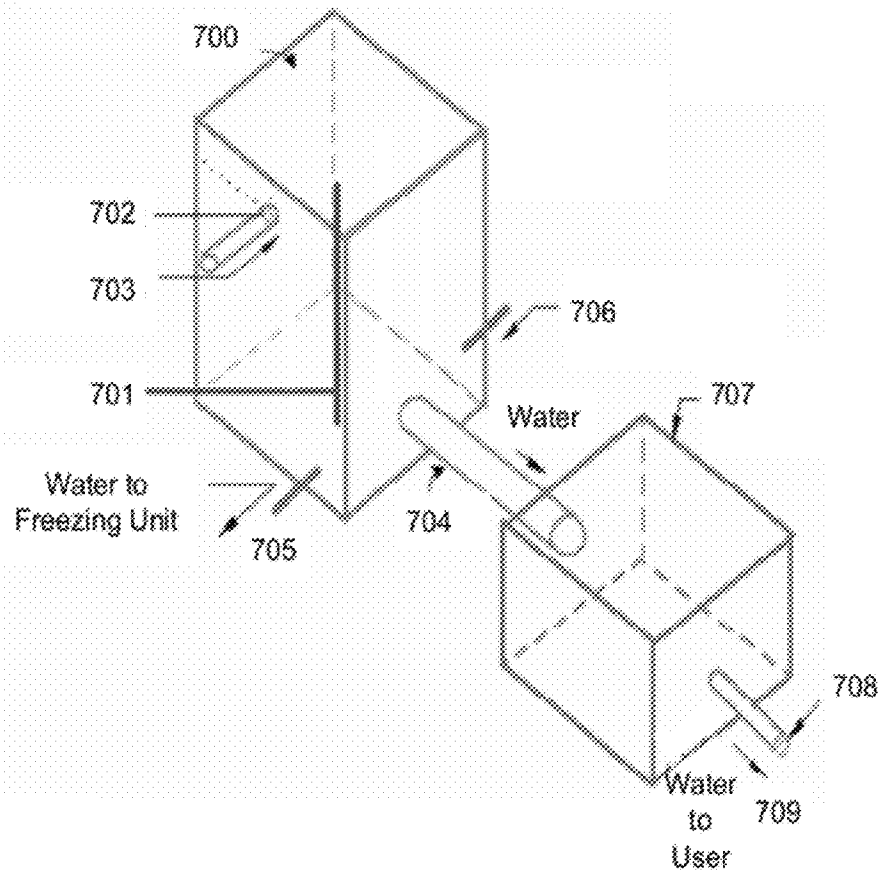
FIG. 7 depicts an example first liquid storage container and second liquid storage container for use in an example system for liquid purification and defrosting a freezing unit.

FIG. 7 depicts an example first liquid storage container 700 and second liquid storage container 707 for use in an example system for liquid purification and defrosting a freezing unit. FIG. 7 adds to FIG. 6 the second liquid storage container 707 to which liquid is carried from the first liquid storage container 700 through pipe 704. Additionally, the second liquid storage container 707 is shown connected to the second filter 708 through which the liquid may flow before use 709.

Figure 8:
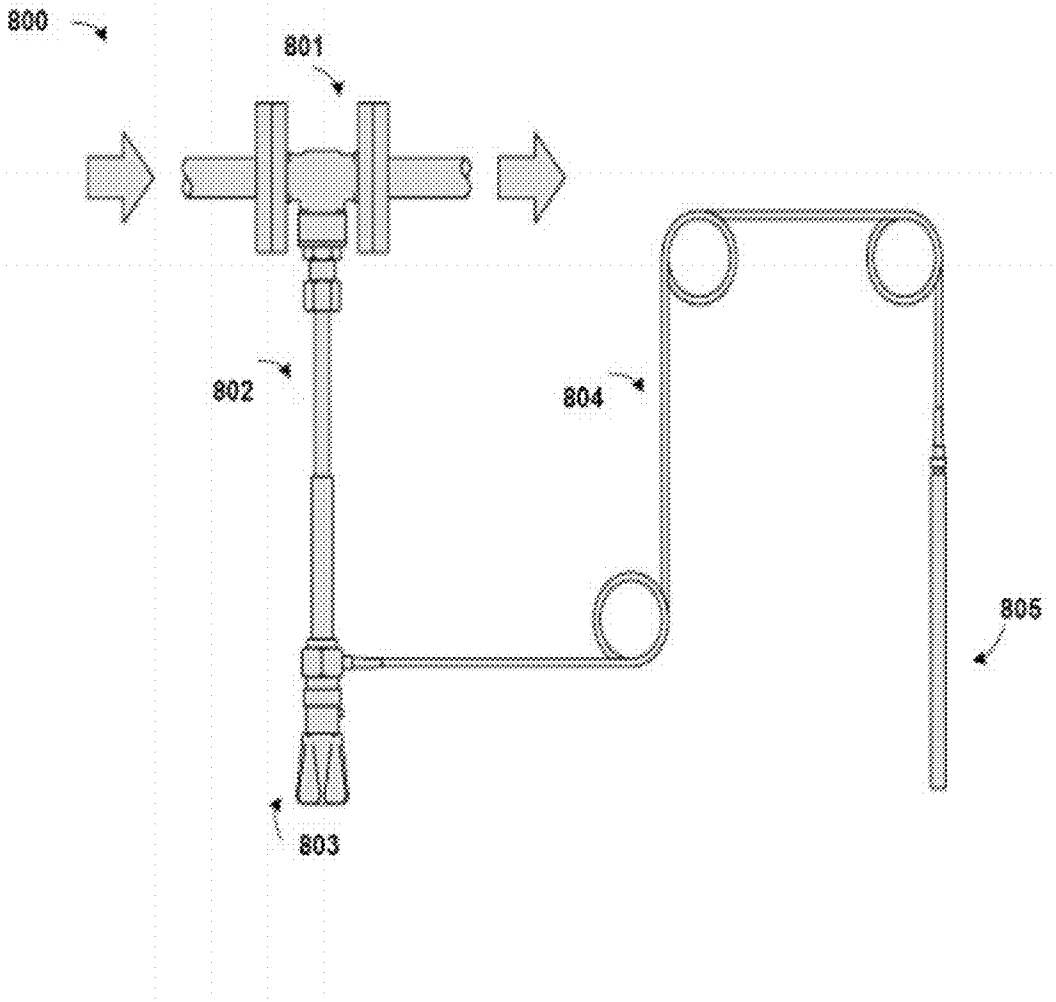
FIG. 8 depicts an example control valve for use in an example system for liquid purification.

FIG. 8 depicts an example self-acting control system 800 for use in an example system for liquid purification. The self-acting valve system 800 includes a temperature control valve 801, a valve actuator 802, a set-temperature knob 803, capillaries 804, and a sensor 805. The temperature control valve 801 controls a flow of liquid from a first liquid storage container to a second liquid storage container. In some embodiments, the temperature control valve 801 allows liquid to flow from the first liquid storage container to the second liquid storage container only when the temperature of the liquid is above a threshold temperature. In some embodiments, this threshold temperature may be 45° C. The threshold temperature may increase with the size of the refrigerator. If such a temperature control valve 801 is in use, no water below the threshold temperature will flow from the first liquid storage container to the second liquid storage container.

The principle of the self-acting temperature control system 800 is that the liquid will only flow through the temperature control valve 801 when the sensor 805 is sensing a temperature that is above a threshold temperature. An example self-acting temperature control system 801 makes use of a sensor 805 containing a heat sensitive liquid, such that when the sensor is sensing a threshold temperature or above, the liquid contained in the sensor expands. This expansion spreads through the capillaries 804 and the force of the expansion triggers the valve actuator 802 and opens the temperature control valve 801. The temperature at which the valve actuator 802 is triggered may be controlled by the set-temperature knob 803.

Thus, in the system for liquid purification and defrosting a freezing cabinet, a self-acting temperature control system 800 can be implemented such that liquid will move from the first liquid storage container to the second liquid storage container only when the liquid in the first liquid storage container is above the threshold temperature set using the set-temperature knob 803 on the self-acting temperature control system 800.

In some embodiments, alternately or additionally, the temperature control valve 801 may only allow a portion of the liquid in the first liquid storage container to flow to from the first liquid storage container to the second liquid storage container on an as needed basis, such as when an amount of liquid in the second liquid storage container falls below a threshold. As a non-limiting example, if the capacity of the second liquid storage container is 5 liters, the threshold may be 4 liters. In this example, no water will flow into the second liquid storage container when the amount of liquid in the second liquid storage container exceeds 4 liters.

The self-acting temperature control system 800 assists in ensuring the purity of liquid flowing through the system for liquid purification. If liquid were to move from the first liquid storage container to the second liquid storage container at a moment when the temperature difference between the containers was insufficient for "thermal shock", no denaturation of bacteria in the liquid would occur. This risk can be reduced through the addition of the self-acting temperature control system 800. When the self-acting temperature control system 800 is used, the liquid will only move from the first liquid storage container to the second liquid storage container when the liquid is at or above a given temperature, eliminating the risk that liquid might move from the first liquid storage container to the second liquid storage container without undergoing "thermal shock". In some embodiments, the given temperature may be about 45° C. More broadly, the given temperature may be in the range of 45-60° C. This temperature may increase with the size of the refrigerator. The time required for thermal shock may vary based on the actual temperature of the liquid from the first liquid storage unit and the internal temperature of the second liquid storage container. In some embodiments, the temperature difference between the first liquid storage container and the second liquid storage container may be in the range of 35-50° C. In some embodiments, the liquid in the second liquid storage container may be further chilled before being output to a user for consumption. For example, the liquid in the second liquid storage container may be chilled to about 10° C., In some embodiments, the liquid used to defrost the freezing unit may be removed from the bottom of the first liquid storage container. In the event that the condenser is located beneath the first liquid storage container, the liquid at the bottom of the first liquid storage container may be the warmest, In some embodiments, the temperature of the liquid at the bottom of the first liquid storage container may be in the range of 47-62° C., FIG. 9 depicts an example circuit to control a pump in an example system for defrosting a freezing unit. The pump is operable to pump liquid from the first liquid storage container to the at least one heat conducting pipe. In some embodiments, the pump pumps liquid from the first liquid storage container to the at least one heat conducting pipe on a periodic basis. The circuit 900 shown in FIG. 9 may control the frequency at which the pump pumps liquid from the first liquid storage container to the at least one heat conducting pipe.

Figure 9:
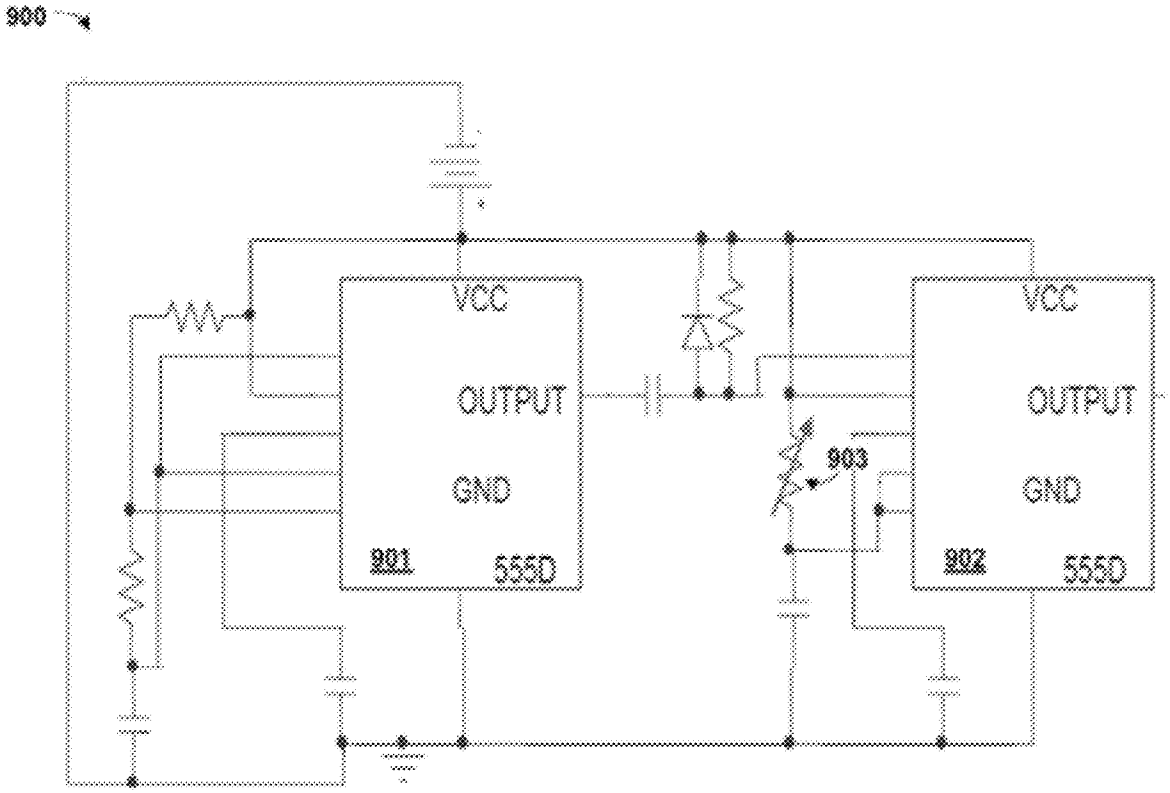
FIG. 9 depicts an example circuit to control a pump in an example system for defrosting a freezing unit.

The circuit shown in FIG. 9 includes a first 555D times 901 and a second 55D timer 902 that convert current to a square pulse. The square pulse controls when the pump is on and off.

The length of time that the pump remains on may be varied by changing the resistance of the resistor 903 on the second 555D timer 902. The circuit 900 of FIG. 9 is shown merely by way of illustration. Variation of components in the circuit, both in number and type, is possible.

The rate of pumping liquid through the at least one heat conducting pipe to keep the freezing unit defrosted is inversely proportional to the temperature of the interior of the freezing unit. As the temperature of the freezing unit is lowered, the frequency of pumping can be increased. In some embodiment, the liquid may be pumped through the at least one heat conducting pipe once every 60 minutes. In some embodiments, the liquid may remain in the at least one heat conducting pipe for 2 or 3 minutes to defrost the freezing unit. This amount of time may be controlled by the resistance of the resistor 903.

Figure 10:
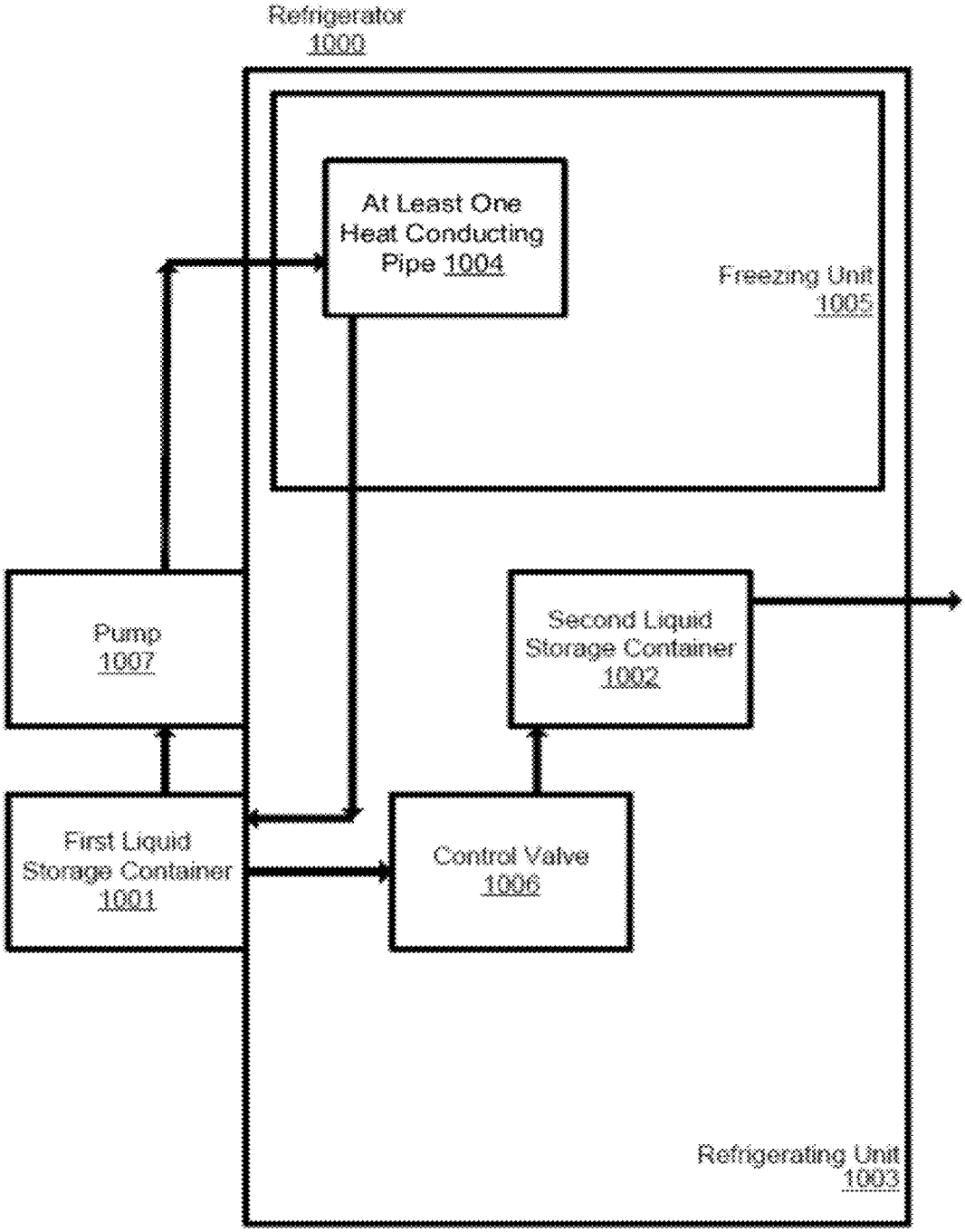
FIG. 10 depicts another example refrigerator including a system for liquid purification and defrosting a freezing unit.

FIG. 10 depicts another example refrigerator for an example system for liquid purification and defrosting a freezing unit. As shown in FIG. 10, a first liquid storage container 1001 is located outside of a refrigerator 1000. The first liquid storage container 1001 is connected to a second liquid storage container 1002 located inside a refrigerating unit 1003 of the refrigerator 1000 and at least one heat conducting pipe 1004 located inside a freezing unit 1005 of the refrigerator 1000.

A control valve 1006 controls flow of liquid from the first liquid storage container 1001 to the second liquid storage container 1002. Liquid from the second liquid storage container 1002 can be removed to outside the refrigerator 1000 for use. This liquid has been purified by undergoing thermal shock and optionally filtration.

A pump 1007 controls flow of liquid from the first liquid storage container 1001 to the at least one heat conducting pipe 1004. Liquid from the at least one heat conducting pipe 1004 is returned to the first liquid storage container 1001. The liquid flowing through the at least one heat conducting pipe 1004 serves to defrost the freezing unit 1005.

Figure 11:
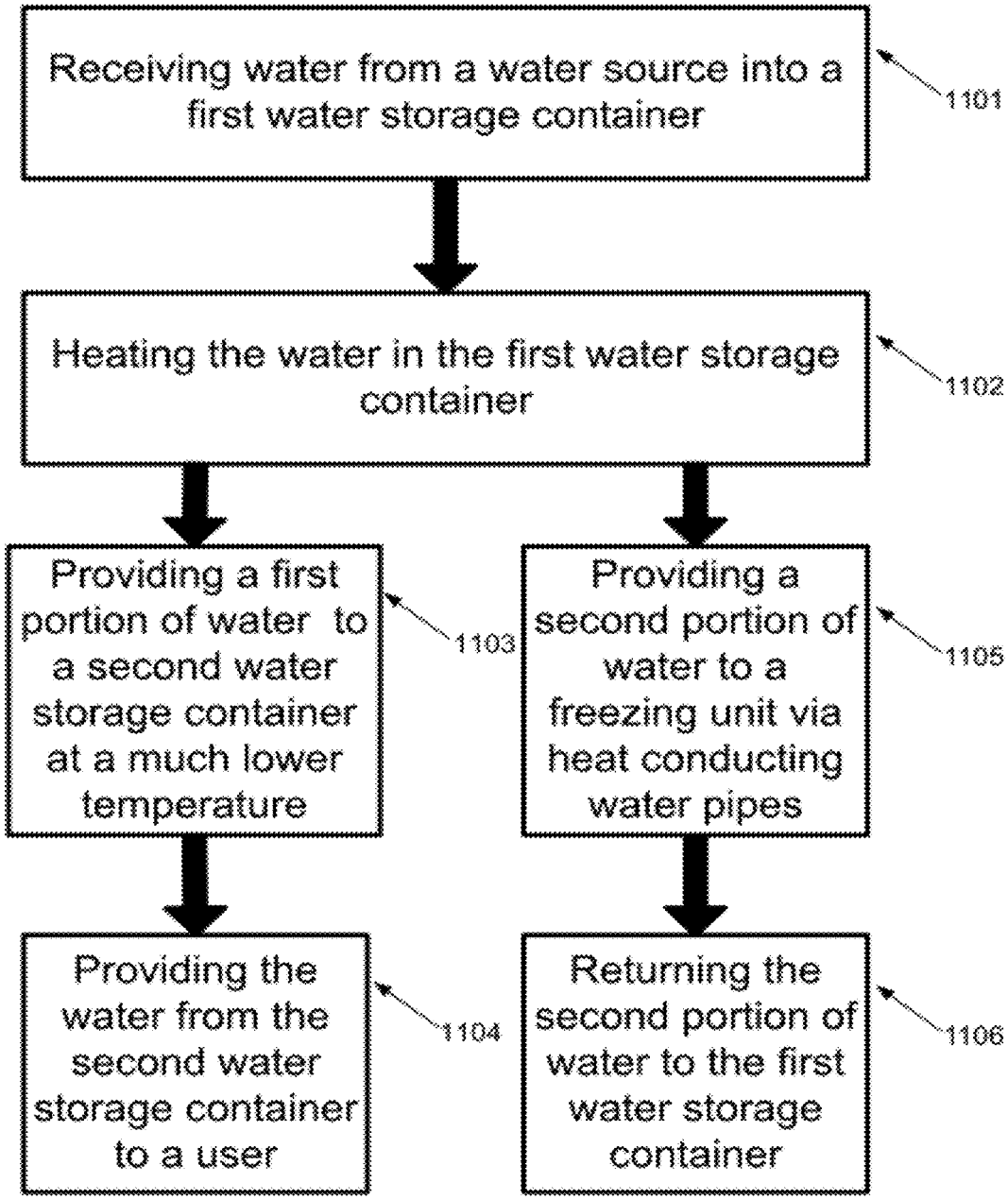
FIG. 11 is a flow chart depicting example steps for purifying water and defrosting a freezing unit.

FIG. 11 is a flow chart depicting example steps for purifying water and defrosting a freezing unit. Initially, water is received from a water source into a first water storage container, as shown at block 1101. In some embodiments, the water may be received through a first filter to remove some impurities from water entering the first water storage container.

Water in the first water storage container is then heated, as shown in block 1102. In some embodiments, the first water storage container includes at least one heat conducting rod that collects heat from the condenser that may be used to help heat the water in the first water storage container.

A first portion of the water in the first water storage container is provided to a second water storage container that is maintained at a much lower temperature, as shown at block 1103. In some embodiments, a determination is made whether the second water storage container includes an amount of water below a threshold level, and the first portion of water is provided to the second water storage container based on this determination. Further, the water in the first water storage container is heated to a first temperature and the water in the second water storage container is maintained at a second temperature such that the first temperature is sufficiently greater than the second temperature to denature bacteria in the first portion of water when the first portion of water is provided to the second water storage container, for example.

The water from the second water storage container can be provided to a user, as shown at block 1104. In some embodiments, the water may be removed through a second filter to remove some impurities from the water leaving the second water storage container. The first portion of water has been purified through the first filter, the denaturing of bacteria. Optionally, the first portion of water may have been further purified through the first filter and the second filter, as described above.

A second portion of the water in the first water storage container is provided to a freezing unit via at least one heat conducting pipe, as shown at block 1105. The second portion of water flows through the at least one heat conducting pipe and, as shown in block 1106, the second portion of the water is returned to the first water storage container. The second portion of the water that flows through the at least one heat conducting pipe serves to defrost the freezing unit.

The method shown in FIG. 11 may be carried out on a periodic basis, such as one or more times every hour or day. The method shown in FIG. 11 may alternatively be performed on a continuous basis.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A system comprising:

a condenser releasing heat;

a first liquid storage container including at least one heat conducting rod that collects heat released from the condenser and heats liquid contained in the first liquid storage container;

a second liquid storage container connected to the first liquid storage container, wherein the second liquid storage container receives heated liquid from the first liquid storage container, and wherein a temperature of liquid in the second liquid storage container is lower than a temperature of liquid in the first liquid storage container, wherein transfer of a portion of the heated liquid from the first liquid storage container to the second liquid storage container causes the heated liquid to decrease in temperature resulting in denaturation of bacteria in the heated liquid; and at least one heat conducting pipe connected to the first liquid storage container, wherein the at least one heat conducting pipe transfers a portion of the heated liquid between the first liquid storage container and a freezing unit causing defrosting of the freezing unit.

2. The system of claim 1, further comprising a control valve that controls a flow of the heated liquid from the first liquid storage container to the second liquid storage container.

3. The system of claim 2, wherein the control valve allows the portion of the heated liquid to flow from the first liquid storage container to the second liquid storage container when an amount of liquid in the second liquid storage container falls below a threshold.

4. The system of claim 2, wherein the control valve allows the portion of the heated liquid to flow from the first liquid storage container to the second liquid storage container when the temperature of the heated liquid is above a threshold temperature.

5. The system of claim 1, further comprising a pump operable to pump the portion of the heated liquid from the first liquid storage container to the at least one heat conducting pipe.

6. The system of claim 5, wherein the pump pumps the portion of the heated liquid from the first liquid storage container to the at least one heat conducting pipe on a periodic basis.

7. The system of claim 1, further comprising:

a first filter connected to the first liquid storage container for removing impurities from liquid entering the first liquid storage container; and a second filter connected to the second liquid storage container for removing impurities from liquid leaving the second liquid storage container.

8. The system of claim 7, wherein at least one of the first filter or the second filter is a 0.2 μm filter.

9. The system of claim 1, wherein the liquid is water.

10. A system comprising:

a first liquid storage container including at least one heat conducting rod located inside the first liquid storage container;

a refrigerator including:

a condenser releasing heat;

a second liquid storage container located inside a refrigerating unit of the refrigerator, wherein the second liquid storage container is connected to the first liquid storage container and receives heated liquid from the first liquid storage container; and at least one heat conducting pipe located inside a freezing unit of the refrigerator, wherein the at least one heat conducting pipe is connected to the first liquid storage container and transfers heated liquid between the first liquid storage container and the freezing unit.

11. The system of claim 10, wherein the at least one heat conducting rod is in thermal contact with the condenser.

12. The system of claim 11, wherein the at least one heat conducting rod absorbs heat from the condenser to heat liquid in the first liquid storage container.

13. The system of claim 10, further comprising a control valve controlling a flow of liquid from the first liquid storage container to the second liquid storage container, wherein the control valve allows liquid to flow from the first liquid storage container to the second liquid storage container when an amount of liquid in the second liquid storage container falls below a threshold.

14. The system of claim 10, further comprising a control valve controlling a flow of liquid from the first liquid storage container to the second liquid storage container, wherein the control valve allows heated liquid to flow from the first liquid storage container to the second liquid storage container when the temperature of the heated liquid is above a threshold temperature.

15. The system of claim 10, further comprising a pump operable to pump heated liquid from the first water storage container to the at least one heat conducting pipe.

16. The system of claim 10, further comprising:

a first filter connected to the first liquid storage container for removing impurities from liquid entering the first liquid storage container; and a second filter connected to the second liquid storage container for removing impurities from liquid leaving the second liquid storage container.

17. The system of claim 10, wherein liquid in the second liquid storage container is of a lower temperature than liquid in the first liquid storage container such that when the second liquid storage container receives liquid from the first liquid storage container, a decrease in temperature denatures bacteria in the liquid.

18. A method of purifying water and defrosting a freezing unit, the method comprising:

receiving water from a water source into a first water storage container;

heating the water in the first water storage container using heat collected from a condenser;

making a determination whether a second water storage container that is connected to the first water storage container includes an amount of water below a threshold level;

based on the determination, providing a first portion of the water in the first water storage container to the second water storage container;

providing a second portion of the water in the first water storage container to a freezing unit causing defrosting of the freezing unit;

providing the water in the second water storage container to a user;

returning the second portion of the water from the freezing unit to the first water storage container.

19. The method of claim 18, carried out on a periodic basis.

20. The method of claim 18, wherein the water in the first water storage container is heated to a first temperature, the water in the second water storage container is maintained at a second temperature, and wherein the first temperature is sufficiently greater than the second temperature to denature bacteria in the first portion of water when the first portion of water is provided to the second water storage container.

* * * * *

UNITED STATES PATENT AND TRADEMARK OFFICE

CERTIFICATE OF CORRECTION

PATENT NO. : 8,516,837 B2
APPLICATION NO. : 13/030899
DATED : August 27, 2013
INVENTOR(S) : Swarup et al.

It is certified that error appears in the above-identified patent and that said Letters Patent is hereby corrected as shown below:

In the Specification

In Column 2, Line 56, delete "unit;" and insert -- unit; and --, therefor.

In Column 4, Line 26, delete "condenser 204." and insert -- condenser 203. --, therefor.

In Column 6, Line 41, delete "first liquid storage 205 container" and insert -- first liquid storage container 205 --, therefor.

In Column 7, Line 39, delete "self-acting control system 800" and insert -- self-acting temperature control system 800 --, therefor.

In Column 8, Line 47, delete "C.," and insert -- C. --, therefor.

In Column 8, Line 55, delete "C.," and insert -- C. --, therefor.

In Column 8, Line 66, delete "second 55D" and insert -- second 555D --, therefor.

Signed and Sealed this
Twelfth Day of November, 2013

Teresa Stanek Rea

Teresa Stanek Rea
*Deputy Director of the United States Patent and Trademark Office*